US007121183B2

(12) United States Patent
Waid et al.

(10) Patent No.: US 7,121,183 B2
(45) Date of Patent: Oct. 17, 2006

(54) METHODS AND SYSTEMS FOR ESTIMATING WEAPON EFFECTIVENESS

(75) Inventors: James D. Waid, Bradenton, FL (US); Brian E. Fly, Clearwater, FL (US)

(73) Assignee: Honeywell International Inc., Morristown, NJ (US)

( * ) Notice: Subject to any disclaimer, the term of this patent is extended or adjusted under 35 U.S.C. 154(b) by 278 days.

(21) Appl. No.: 10/811,666

(22) Filed: Mar. 29, 2004

(65) Prior Publication Data

US 2005/0211083 A1 Sep. 29, 2005

(51) Int. Cl.
*F41G 3/00* (2006.01)

(52) U.S. Cl. ..... 89/1.11; 89/41.01

(58) Field of Classification Search ..... 89/1.11, 89/41.01

See application file for complete search history.

(56) References Cited

U.S. PATENT DOCUMENTS 4,830,311 A 5/1989 Pritchard et al.
5,153,366 A * 10/1992 Lucas ..... 89/1.11
5,260,709 A 11/1993 Nowakowski
5,456,157 A 10/1995 Lougheed et al.
5,511,218 A * 4/1996 Castelaz ..... 718/102
5,686,690 A 11/1997 Lougheed et al.
5,760,737 A 6/1998 Brenner
5,943,009 A 8/1999 Abbott
6,199,470 B1 3/2001 Dewan et al.
6,201,496 B1 3/2001 Lee
6,237,496 B1 5/2001 Abbott
6,467,388 B1 * 10/2002 Malakatas ..... 89/41.03
6,796,213 B1 * 9/2004 McKendree et al. ..... 89/1.11

* cited by examiner

*Primary Examiner*—Stephen M. Johnson
(74) *Attorney, Agent, or Firm*—Dina Khaled, Esq.; Armstrong Teasdale LLP

(57) ABSTRACT

Methods and systems for providing an estimate of effectiveness of a selected weapon against a selected target prior to release of the weapon are described. One described method comprises receiving a position uncertainty for a weapon platform, receiving a position uncertainty for a selected target, and determining an ability of the selected weapon to navigate to the selected target. An estimated effectiveness of the selected weapon is determined utilizing one or more of the weapon platform position uncertainty, the target position uncertainty, the navigation capability of the selected weapon, and a kill radius for the selected weapon.

26 Claims, 3 Drawing Sheets

METHODS AND SYSTEMS FOR ESTIMATING WEAPON EFFECTIVENESS

BACKGROUND OF THE INVENTION

This invention relates generally to weapon targeting systems, and more specifically, to methods and systems for providing a user with an indication of weapon effectiveness against a selected target prior to release.

Current weapon delivery methodology for destroying or disabling a target include delivering a larger amount of ordnance than is necessary to the target. The larger amounts of ordnance are utilized to account for uncertainty in weapon positioning and uncertainty in the guidance systems directing the weapon to the target. In other words, the larger amount of ordnance compensates for the probability that the ordnance likely will not land exactly where planned. However, utilization of larger amounts of ordnance results in an increase in the likelihood of collateral damage. Sometimes the targets to be destroyed or disabled are located in civilian or populated areas. Therefore, it is important to limit collateral damage.

Standards for aircraft approach and landing in civil aviation include integrity requirements on the navigation and positioning solutions provided to the pilot from various flight systems (e.g., inertial navigation systems, GPS). Such standards are in place to provide the pilot with an assurance that the aircraft is indeed at the calculated position with a high degree of certainty. One such example is the location of the aircraft with respect to a runway as it approaches the runway for landing. For obvious reasons it is important that the navigation and positioning solutions be accurate. The above mentioned flight systems provide the pilot or flight crew with an indication of the probability that the aircraft is located at the position indicated by the flight instruments or display systems. Such indications are sometimes referred to as position uncertainties.

BRIEF SUMMARY OF THE INVENTION

In one aspect, a method for providing an estimate of effectiveness of a selected weapon against a selected target prior to release of the weapon is provided. The method comprises receiving a position uncertainty for a weapon platform, receiving a position uncertainty for a selected target, determining the ability of the selected weapon to navigate to the selected target, and estimating an effectiveness of the selected weapon. The effectiveness is estimated utilizing one or more of the weapon platform position uncertainty, the target position uncertainty, the navigation capability of the selected weapon, and a kill radius for the selected weapon.

In other aspect, a computer program and a weapons systems are provided. The computer program comprises software modules for receiving a position uncertainty for a weapon platform, receiving a position uncertainty for a selected target, determining the ability of a selected weapon to navigate to the selected target, and estimating an effectiveness of the selected weapon against the selected target. The estimating effectiveness module utilizes one or more of weapon platform position uncertainty, target position uncertainty, navigation capability of the selected weapon, and the kill radius for the selected weapon.

DETAILED DESCRIPTION OF THE INVENTION

Figure 1:
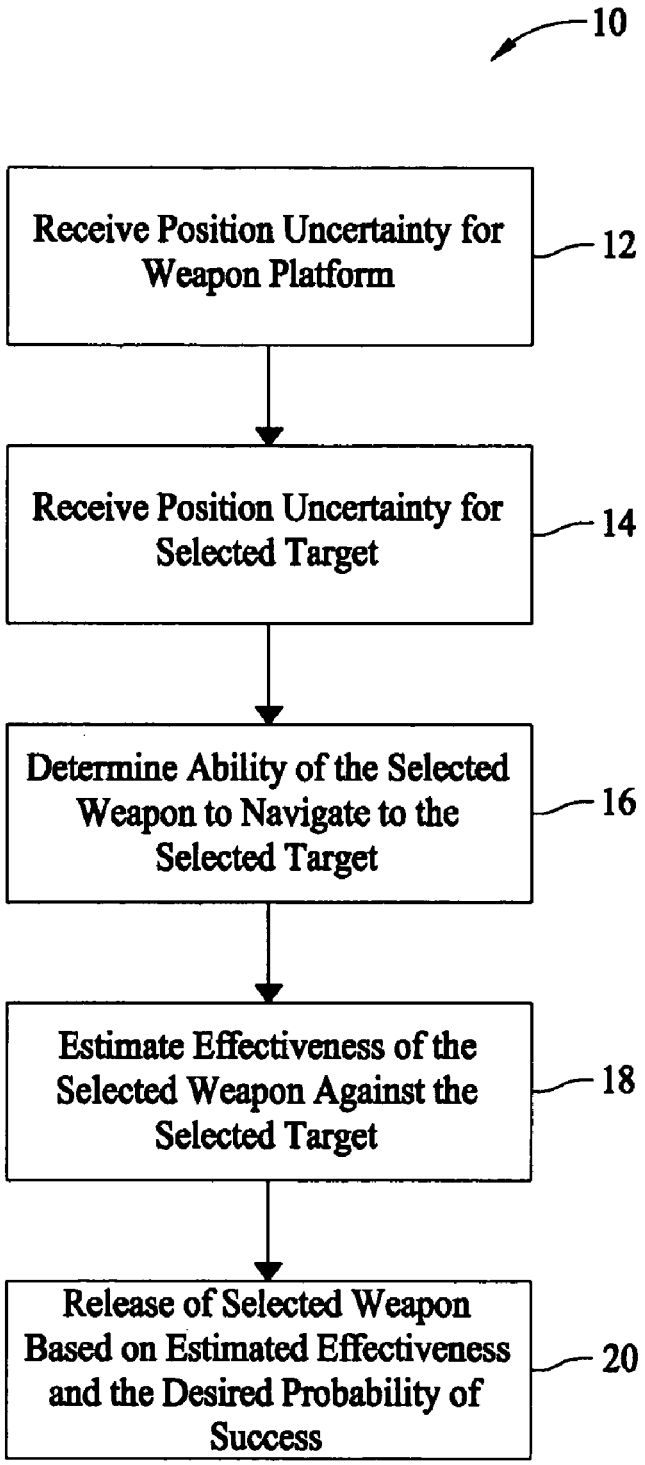
FIG. 1 is a flowchart illustrating a method for estimating an effectiveness of a weapon.

Methods and systems are described herein for applying navigation and positioning integrity techniques developed for aviation to determine a position uncertainty for the tactical environment. Such techniques include integrity calculations for navigation and positioning solutions (e.g., an uncertainty related to an aircraft position) which are provided to a pilot from various navigation systems (e.g., inertial navigation systems, GPS). Results of the integrity calculations provide a relative assurance that an aircraft is indeed at the calculated position with a high degree of certainty, for example, during an approach and landing. One source of error is a navigation sensor error which reflects the ability of the navigation sensors to accurately determine the position of the aircraft, for example. One example is a degree of uncertainty in a position reported by a GPS system. Another error source is sometimes referred to as a flight technical error which is based upon the ability of a flight control system (or pilot) to accurately follow a commanded flight path. Navigation sensor errors, flight control system errors, pilot error, and the like are included in the calculation of position uncertainties.

The methods and systems described herein incorporate the above described integrity calculations for navigation and positioning and apply such calculations to the accurate delivery of weapons relative to a desired impact area. Specifically, weapon position and guidance solutions are calculated within a weapons system utilizing the same methods that are used to determine an uncertainty in the position of an aircraft as above described. Such weapon position and guidance solution techniques are also applicable to so called "dumb" weapons, which are weapons not incorporating internal navigation systems. The benefits of using the data for the positioning of an aircraft for the delivery of weapons provides for more reliable and effective use of such weapons and enable use of smaller yield warheads to achieve the same results as in previous weapon delivery methods.

In one embodiment, a probability of success for weapons delivery is a function of one or more of weapon position uncertainty, target location uncertainty, the weapon's ability to navigate to the desired impact point, and a kill radius for the weapon. These uncertainty parameters are analogous to civil aviation integrity problems and Table 1 illustrates the relationships between the weapon delivery uncertainty parameters and the civil aviation integrity problems.

TABLE 1

| Aviation Parameter | Tactical Parameter | Description |
|---|---|---|
| Navigation Sensor Error | Position uncertainty | The ability of the navigation sensors to accurately determine position. Positioning error to desired probability. |

TABLE 1-continued

| Aviation Parameter | Tactical Parameter | Description |
|---|---|---|
| Flight Technical Error | weapon's ability to navigate to the desired impact point | Flight control system ability to follow commanded flight path. Autopilot or pilot error in following desired path. |
| Path Definition Error | target location uncertainty | Error in determining the actual desired trajectory. For civil applications, this is typically assumed to be zero. |
| Total System Error | Target miss distance | Root sum square of all the errors in the position relative to desired position. |
| | Weapon kill radius | How close to the target does the weapon have to land to successfully disable or destroy the target? |

FIG. 1 is a flowchart 10 depicting a method for estimating an effectiveness of a weapon utilizing calculations of the above described errors. First, the position uncertainty for the weapon is received 12 based on a position uncertainty for the weapon platform (e.g., an aircraft). A position uncertainty is also received 14 for a selected target. An ability of a selected weapon to navigate to the selected target is also determined 16. The position uncertainties and the navigation ability in addition to a kill radius of the selected weapon, are utilized to estimate 18 an effectiveness of the selected weapon against the selected target. As shown in Table 1, the estimated effectiveness is sometimes referred to as a total system error and is, in one embodiment, a root-sum-square of the position uncertainties, the navigation ability of the selected weapon, and the kill radius of the selected weapon. The selected weapon is released 20 (or not released) based upon the estimated effectiveness and mission objectives.

Figure 2:
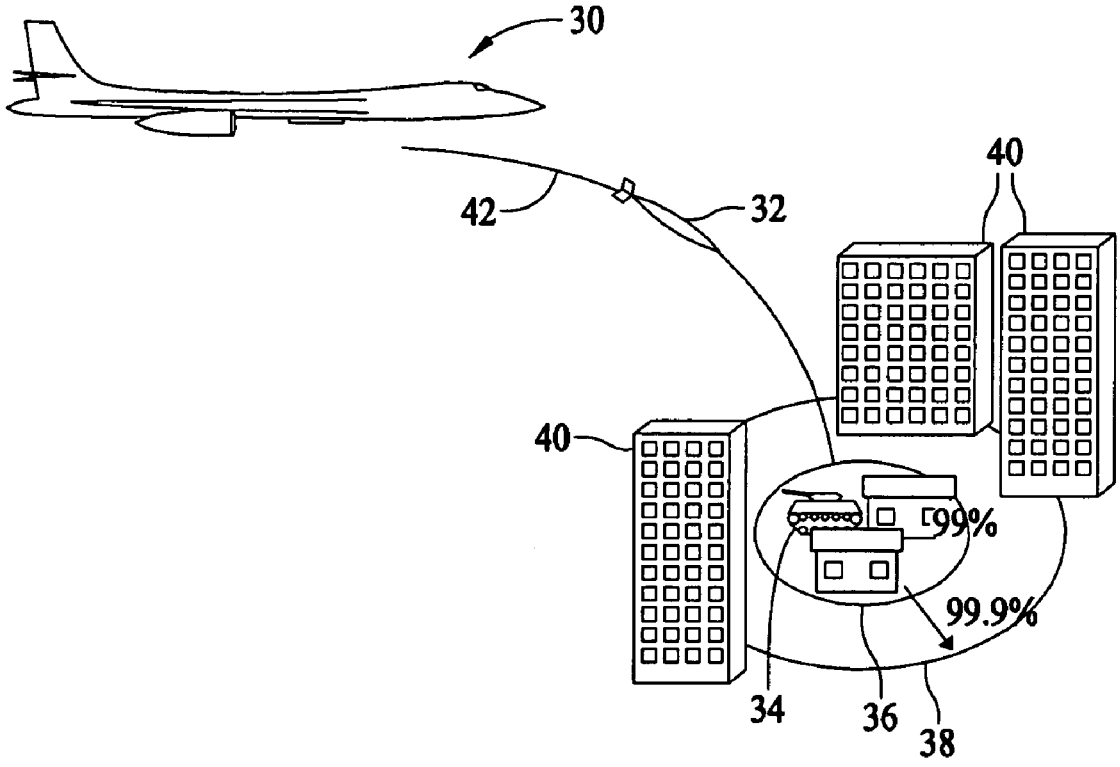
FIG. 2 is an illustration of weapon delivery from a weapon platform to a target.

Delivery of a selected weapon is illustrated in FIG. 2. A weapon platform 30 (e.g., aircraft) is illustrated delivering a weapon 32 to a target 34, for example, a mobile rocket launcher. Two regions 36 and 38 respectively are shown which represent an impact area and a confidence that weapon 32 will land within that region. As an example, region 36 indicates that weapon 32 has a 99% probability of destroying target 34, while region 38 indicates that weapon 32 has a 99.9% probability of disabling (not necessarily destroying) the target 34. It is desirable that weapon 32 land within region 36, in an attempt to avoid collateral damage to buildings 40 and any civilians within. As described above, there is a position uncertainty with respect to weapon platform 30 and target 34. In addition, there is an uncertainty with respect to a trajectory 42 of weapon 32 all of which can be utilized in determining an estimate of weapon effectiveness.

Taking into account all of the above described tactical parameters the system provides a result that is an estimate of weapon effectiveness for a current target (e.g., target 34), using a selected weapon (e.g., weapon 32) and an environment in which weapon 32 is being utilized. Stated mathematically, a probability of success that a weapon will be effective against a selected target is a function of position uncertainty (for the weapon platform), target position uncertainty, weapon guidance accuracy, and a weapon kill radius, or $$Pr(\text{success})=f(\text{position uncertainty, target uncertainty, weapon guidance accuracy, weapon kill radius})$$

A probability of success that weapon 32 will land in the desired region (e.g., the effectiveness estimate) may be presented to the user in multiple formats. One format is a simple GO/NOGO indication for the release of weapon 32 based on a pre-determined (desired) probability of success that weapon 32 will destroy or disable target 34. Alternatively the probability of success calculation may be presented directly to a user, for example, a weapons systems officer in charge of releasing weapons 32. The GO/NOGO indication, in one embodiment, is presented to the user as a simple release indicator light. In another embodiment, a graphical representation of a probable weapon effective kill radius relative to the target is presented to the user.

Figure 3:
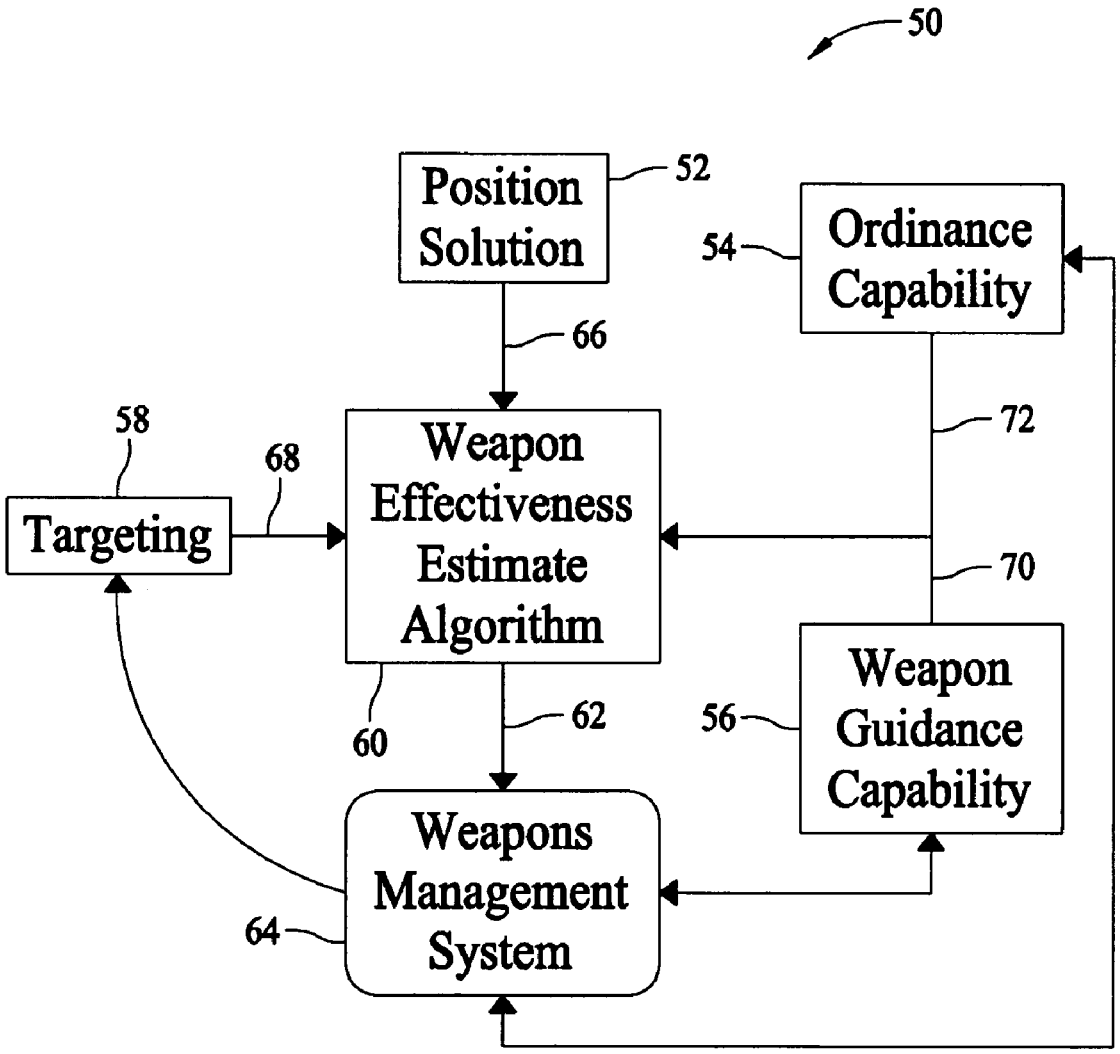
FIG. 3 is a function flow diagram for determining weapon effectiveness.

The estimate of the effectiveness of weapon 32 is one result of the method illustrated in FIG. 1. FIG. 3 illustrates a function flow diagram 50 for determining an effectiveness of a weapon. A position solution 52, an ordinance capability 54, a weapon guidance capability 56, and targeting information 58 are sources of information to a weapon effectiveness estimating algorithm 60 incorporating one or more embodiments of the above described probability of success function. A weapons effectiveness estimation 62 is output from weapon effectiveness estimating algorithm 60 to a weapons management system 64 for managing a weapons platform (not shown) or presenting a user with a display on a user interface as to an estimated effectiveness of a selected weapon.

With regard to position solution 52, sometimes referred to as a navigation solution, a platform position and a position uncertainty 66 are provided by an embedded GPS/inertial (EGI) navigation system. In one embodiment, position uncertainty is directly computed by the EGI navigation system.

Targeting information 58 includes target location information 68 and further may include data on the type of target (e.g., target 34 shown in FIG. 2). In one embodiment, targeting information 58 includes information about the environment in which the target is located, for example, buildings, people, landscape, and protection. Target location information 68 is provided by a number of sources. For example, in specific embodiments, target location information 68 is relative to the weapons platform (e.g., in body coordinates of the weapons platform) or is an absolute position of the target such as latitude, longitude, and elevation.

Target location uncertainty is an important component of target location information 68 provided to weapon effectiveness estimating algorithm 60. Target location uncertainty in one embodiment is an index. In another embodiment, target location uncertainty is an estimated position error. In either embodiment, target location is bounded by a selected level of confidence. A target type is utilized for determining a weapon's ability to destroy or disable the particular target. A target environment is utilized to predetermine the possible collateral damage for an area surrounding the target.

Weapon guidance capability 56 is a representation of an ability of a weapon to navigate to a target. Weapons which include active guidance systems (e.g., missiles) provide a higher level of confidence than do free falling weapons, resulting in a higher weapon guidance capability determination 70 for such weapons. Weapon guidance capability 56 therefore influences determinations of weapon effectiveness. In addition, ordinance capability 54 includes indications of weapon capability 72, for example, a kill radius for a selected weapon and a capability of the weapon against hard or soft targets.

Each of the above described sources of information (e.g., position solution 52, ordinance capability 54, weapon guidance capability 56, and targeting information 58) has an associated uncertainty. In one embodiment, a weapon mission is evaluated from a weapon release from the weapon platform to impact with a target. The uncertainties associated with each of the above described components is normalized and combined to form a region of target impact that corresponds with a desired level of certainty. A weapon effectiveness estimate 62 is also computed utilizing a miss distance and ordinance capability 54 to determine if the weapon will destroy or disable the target with the desired level of certainty. In a specific embodiment, a probability of target destruction, a probability of disabling the target, and collateral damage are estimated by weapon effectiveness estimating algorithm 60.

Calculation of a collateral damage estimate considers all the known items within the region of the target and estimates to a specific level of certainty the impact of the weapon to those items. In one embodiment, the collateral damage estimate takes on the form of an index that reflects a standard level of acceptance for the individual situation.

Tactical utilization of the systems and methods described herein enhance the current and planned integrated navigation systems and mission effectiveness by increasing confidence in weapon success prior to release of the weapon against a target. In addition, an increasing confidence in weapon success provides a resultant decrease in the possible collateral damage, which is important with respect to civilian and urban areas. Another benefit includes utilization of smaller warheads to obtain the same results as in prior systems which allows the same aircraft to carry an increased quantity of smaller weapons, increasing the targeting opportunities for a single mission. Costs are reduced, as fewer missions will be required to achieve the same results.

While the invention has been described in terms of various specific embodiments, those skilled in the art will recognize that the invention can be practiced with modification within the spirit and scope of the claims.

What is claimed is:

1. A method for providing an estimate of effectiveness of a selected weapon against a selected target prior to release of the weapon, said method comprising:

receiving a position uncertainty for a weapon platform;

receiving a position uncertainty for a selected target;

determining an ability of the selected weapon to navigate to the selected target; and estimating an effectiveness of the selected weapon utilizing at least one of the weapon platform position uncertainty, the target position uncertainty, the navigation capability of the selected weapon, and a kill radius for the selected weapon.

2. A method according to claim 1 further comprising causing a release of the selected weapon based upon the estimated effectiveness.

3. A method according to claim 1 wherein estimating an effectiveness of the weapon comprises at least one of estimating a probability of target destruction, estimating a probability of disabling the target, and estimating an amount of collateral damage.

4. A method according to claim 1 further comprising presenting the effectiveness estimate to a user.

5. A method according to claim 4 wherein presenting the effectiveness estimate comprises presenting a user with a GO/NOGO indication with respect to the release of the weapon.

6. A method according to claim 5 wherein the GO/NOGO indication is based on a comparison between the effectiveness estimate and a pre-determined probability of success that the weapon will destroy or disable the target.

7. A method according to claim 4 wherein presenting the effectiveness estimate comprises presenting a user with a graphical representation of a probable weapon effective kill radius relative to the target.

8. A method according to claim 1 wherein receiving a position uncertainty for a weapon platform comprises receiving a platform position and a position uncertainty from an embedded GPS/inertial navigation system.

9. A method according to claim 1 wherein receiving a position uncertainty for a selected target further comprises receiving information about the environment in which the target is located.

10. A method according to claim 1 wherein receiving a position uncertainty for a selected target further comprises receiving target location information either relative to the weapons platform or an absolute target position.

11. A method according to claim 1 wherein receiving a position uncertainty for a selected target comprises bounding a target location with a selected confidence level.

12. A method according to claim 1 wherein receiving a position uncertainty for a selected target further comprises receiving a target type.

13. A method according to claim 1 further comprising calculating a collateral damage estimate by:

considering all the known items within the region of the target; and estimating to a specific level of certainty the impact of the weapon to the known items.

14. A weapons system programmed to:

receive a position uncertainty for a weapon platform;

receive a position uncertainty for a selected target;

determine an ability of e selected weapon to navigate to the selected target; and estimate an effectiveness of the selected weapon against the selected target utilizing one or more of the weapon platform position uncertainty, the target position uncertainty, the navigation capability of the selected weapon, and a kill radius for the selected weapon.

15. A weapons system according to claim 14 programmed to cause a release of the selected weapon based upon the estimated effectiveness.

16. A weapons system according to claim 14 wherein to estimate an effectiveness of the weapon, said weapons system is programmed to estimate at least one of a probability of target destruction, a probability of disabling the target, and an amount of collateral damage.

17. A weapons system according to claim 14 further comprising a user interface, said weapons system programmed to present the effectiveness estimate to a user on said user interface.

18. A weapons system according to claim 17 wherein to present the effectiveness estimate, said system is programmed to display a GO/NOGO indication with respect to the release of the weapon on said user interface.

19. A weapons system according to claim 18 programmed to base the GO/NOGO indication on a comparison between the effectiveness estimate and a pre-determined probability of success that the weapon will destroy or disable the target.

20. A weapons system according to claim 17 wherein said system is programmed to present the effectiveness estimate on said user interface as a graphical representation of a probable weapon effective kill radius relative to the target.

21. A weapons system according to claim 14 wherein to receive a position uncertainty for a weapon platform, said system is programmed to receive a platform position and a position uncertainty from an embedded GPS/inertial navigation system.

22. A weapons system according to claim 14 wherein to receive a position uncertainty for a selected target, said system is programmed to receive information about the environment in which the target is located.

23. A weapons system according to claim 14 wherein to receive a position uncertainty for a selected target, said system is programmed to receive target location information either relative to the weapons platform or as an absolute target position.

24. A weapons system according to claim 14 wherein to receive a position uncertainty for a selected target, said system is programed to bound a target location with a selected confidence level.

25. A weapons system according to claim 14 wherein to receive a position uncertainty for a selected target, said system is programmed to receive a target type.

26. A weapons system according to claim 14 programmed to calculate a collateral damage estimate by:

considering all the known items within the region of the target; and estimating to a specific level of certainty the impact of the weapon to the known items.

* * * * *